US006036297A

United States Patent [19]

Hayasaki

[11] Patent Number: 6,036,297

[45] **Date of Patent: *Mar. 14, 2000**

[54] METHOD AND APPARATUS FOR CORRECTING PRINTHEAD, PRINTHEAD CORRECTION BY THIS APPARATUS, AND PRINTER USING THIS PRINTHEAD

[75] Inventor: Kimiyuki Hayasaki, Yokohama, Japan

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/545,205

[22] Filed: Oct. 19, 1995

[30] Foreign Application Priority Data

Oct. 28, 1994 [JP] Japan ..... 6-265445

[51] Int. Cl.[7] ..... B41J 29/38; B41J 29/393

[52] U.S. Cl. ..... 347/13; 347/19

[58] Field of Search ..... 347/13, 19, 42; 358/504, 406

[56] References Cited

U.S. PATENT DOCUMENTS

| | | | |
|---|---|---|---|
| 4,313,124 | 1/1982 | Hara . | |
| 4,345,262 | 8/1982 | Shirato et al. . | |
| 4,459,600 | 7/1984 | Sato et al. . | |
| 4,463,359 | 7/1984 | Ayata et al. . | |
| 4,558,333 | 12/1985 | Sugitani et al. . | |
| 4,608,577 | 8/1986 | Hori . | |
| 4,723,129 | 2/1988 | Endo et al. . | |
| 4,740,796 | 4/1988 | Endo et al. . | |
| 5,016,023 | 5/1991 | Chan et al. . | |
| 5,038,208 | 8/1991 | Ichikawa et al. | 358/75 |
| 5,098,503 | 3/1992 | Drake | 156/299 |
| 5,157,411 | 10/1992 | Takekoshi et al. | 346/1.1 |
| 5,225,849 | 7/1993 | Suzuki et al. . | |
| 5,300,969 | 4/1994 | Miura et al. . | |
| 5,353,051 | 10/1994 | Katayama et al. . | |
| 5,502,468 | 3/1996 | Knierim | 347/19 |
| 5,504,507 | 4/1996 | Watrobski et al. | 347/19 |
| 5,510,896 | 4/1996 | Wafler | 358/296 |
| 5,596,353 | 1/1997 | Takada et al. | 347/19 |

FOREIGN PATENT DOCUMENTS

| | | |
|---|---|---|
| 0421806 | 4/1991 | European Pat. Off. . |
| 0440492 | 8/1991 | European Pat. Off. . |
| 0452157 | 10/1991 | European Pat. Off. . |
| 0589718 | 3/1994 | European Pat. Off. . |
| 0605216 | 7/1994 | European Pat. Off. . |
| 0670219 | 9/1995 | European Pat. Off. . |
| 54-056847 | 5/1979 | Japan . |
| 55-132253 | 10/1980 | Japan . |
| 4229278 | 2/1982 | Japan . |
| 59-123670 | 7/1984 | Japan . |
| 59-138461 | 8/1984 | Japan . |
| 60-071260 | 4/1985 | Japan . |
| 2002009 | 1/1990 | Japan . |
| 4232749 | 8/1992 | Japan . |
| 5024192 | 2/1993 | Japan . |

*Primary Examiner*—David M. Gray
*Assistant Examiner*—Christopher Mahoney
*Attorney, Agent, or Firm*—Fitzpatrick, Cella, Harper & Scinto

[57] ABSTRACT

Disclosed are a method and apparatus for correcting a full-line printhead, which has a high printing quality, at a high yield, as well as a printhead corrected by this apparatus and a printer using this printhead. Monitoring units are provided to monitor an offset in connections of heater boards connected by a board arraying unit, a variation in the diameters, grooves and shapes of nozzles formed by a top-board machining unit which machines the top board, an offset in bonding between a base plate and the top board performed by a top-board bonding unit, a variation in the resistance value of each printing element measured by an electrical-characteristic measuring unit, and an unevenness of pixels printed by each of the printing elements inspected by a print inspection unit. Correction data is generated upon taking into account the degree of influence which these factors exert upon the printhead, and the correction data is written in an EEPROM provided within the printhead.

21 Claims, 14 Drawing Sheets

METHOD AND APPARATUS FOR CORRECTING PRINTHEAD, PRINTHEAD CORRECTION BY THIS APPARATUS, AND PRINTER USING THIS PRINTHEAD

BACKGROUND OF THE INVENTION

This invention relates to a method and apparatus for correcting a printhead, a printhead corrected by this apparatus, and a printer using this printhead. More particularly, the invention relates to a method and apparatus for correcting, by way of example, a full-line printhead equipped with a plurality of print elements corresponding to the printing width of a recording medium, a printhead corrected by this apparatus, and a printer using this printhead.

A printer or the printing section of a copying machine or facsimile machine is so adapted as to print an image, which comprises a dot pattern, on a recording medium such as a paper, a thin plastic sheet or fabric based upon image information.

Among these printing apparatuses, those which are the focus of attention because of their low cost are mounted with printheads that rely upon the ink-jet method, the thermosensitive-transfer method or the LED method, etc., in which a plurality of printing elements corresponding to dots are arrayed on a base.

In a printhead in which these printing elements are arrayed to correspond to a certain printing width, the printing elements can be formed through a process similar to a semiconductor manufacturing process. Accordingly, a transition is now being made from a configuration in which the printhead and driving integrated circuitry are arranged separately of each other to an integrated assembled configuration in which the driving integrated circuitry is structurally integrated within the same base on which the printing elements are arrayed. As a result, complicated circuitry involved in driving the printhead can be avoided and the printing apparatus can be reduced in size and cost.

Among these types of printing methods, the ink-jet printing method is particularly advantageous. Specifically, according to this method, thermal energy is made to act upon ink and the ink is discharged by utilizing the pressure produced by thermal expansion. This method is advantageous in that the response to a printing signal is good and it is easy to group the orifices close together at a high density. There are greater expectations for this method in comparison with the other methods.

When the printhead is manufactured by applying a semiconductor manufacturing process and, in particular, when numerous printing elements that are to be made to correspond to the printing width are arrayed over the entire area of a base, it is very difficult to manufacture all of the printing elements without any defects. As a consequence, the manufacturing yield of the process for manufacturing the printhead is poor and this is accompanied by higher cost. There are occasions where such a printhead cannot be put into practical use because of the costs involved.

Accordingly, methods of obtaining a full-line printhead have been disclosed in the specifications of Japanese Patent Application Laid-Open (KOKAI) Nos. 55-132253, 2-2009, 4-229278, 4-232749 and 5-24192 and in the specification of U.S. Pat. No. 5,016,023. According to these methods, a number of high-yield printheads each having an array of printing elements of a comparatively small number of orifices, e.g., 32, 48, 64 or 128 printing elements, are placed upon (or upon/below) a single base at a high precision in conformity with the density of the array of printing elements, thereby providing a full-line printhead whose length corresponds to the necessary printing width.

It has recently become possible on the basis of this technique to simply manufacture a full-line printhead by arraying printing elements of a comparatively small number (e.g., 64 or 128) of orifices on bases (also referred to as "printing units") and bonding these printing units in a row on a base plate in highly precise fashion over a length corresponding to the necessary printing width.

Though it has thus become easy to manufacture a full-line printhead, certain performance-related problems remain with regard to a printhead manufactured by the foregoing manufacturing method. For example, a decline in printing quality, such as density unevenness, cannot be avoided. The cause is a variation in performance from one printing unit (base) to another in the row of such printing units, a variation in the performance of neighboring printing elements between the arrayed printing units and heat retained in each driving block at the time of recording.

In particular, in the case of an ink-jet printhead, not only a variation in the neighboring printing elements between the arrayed printing units but also a decline in ink fluidity owing to the gaps between printing units results in lower yield in the final stage of the printhead manufacturing process. For this reason, the state of the art is such that these printheads are not readily available on the market in large quantities regardless of the fact these printheads exhibit highly satisfactory capabilities.

SUMMARY OF THE INVENTION

Accordingly, an object of the present invention is to provide an apparatus and method for correcting a manufactured printhead in order to supply a printhead at a high yield, which printhead is capable of performing high-quality printing.

According to one aspect of the present invention, the foregoing object is attained by providing an apparatus for correcting a printing characteristic of a printhead having memory means for storing data, the printhead being manufactured by arraying means for arraying and connecting N-number of circuit boards, each of which has M-number of printing elements in a predetermined direction, in the predetermined direction, machining means for machining a top board covering the M×N–number of printing elements connected by the arraying means, and bonding means for bonding the machined top board and the connected M×N–number of printing elements, the apparatus comprising: measuring means for measuring electrical characteristics of the M×N–number of printing elements, of a unit of the printhead, bonded by the bonding means; inspecting means for driving the unit of the printhead to experimentally print a test pattern on a recording medium, reading the printed test pattern and inspecting unevenness in printing performed by each of the M×N–number of printing elements; monitor means for monitoring an offset in the connections made by the arraying means, a variation in the machining of the top board by the machining means, an offset in the bonding performed by the bonding means, a deviation in the electrical characteristics of the M×N–number of printing elements measured by the measuring means, and unevenness in printing performed by the M×N–number of printing elements inspected by the inspecting means; correction-data generating means for quantifying the factors monitored by the monitor means, summing the quantified factors upon weighting them while taking into account the magnitude of their influence upon printing quality of the printhead, and, on the basis of the sum obtained, generating correction data for correcting printing unevenness of each of the M×N-number of printing elements; and writing means for writing the correction data in the memory means of the printhead.

According to another aspect of the invention, the foregoing object is attained by providing a method of correcting a printing characteristic of a manufactured printhead having N-number of circuit boards, each of which has M-number of printing elements in a predetermined direction, arrayed in the predetermined direction, and a memory for storing information, the method comprising: an arraying step of arraying and connecting the N-number of circuit boards; a machining step of machining a top board covering M×N-number of printing elements connected in the arraying step; a bonding step of bonding the machined top board and the connected M×N-number of printing elements; a measuring step of measuring electrical characteristics of the M×N-number of printing elements, of a unit of the printhead, bonded in the bonding step; an inspecting step of driving the unit of the printhead to experimentally print a test pattern on a recording medium, reading the printed test pattern and inspecting a variation in printing performed by each of the M×N-number of printing elements; a monitoring step of monitoring an offset in the connections made in the arraying step, a variation in the machining of the top board in the machining step, an offset in the bonding performed in the bonding step, a deviation in the electrical characteristics of the M×N-number of printing elements measured in the measuring step, and unevenness in printing performed by the M×N-number of printing elements inspected in the inspecting step; a correction-data generating step of quantifying the factors monitored in the monitor step, summing the quantified factors upon weighting them while taking into account the magnitude of their influence upon printing quality of the printhead, and, on the basis of the sum obtained, generating correction data for correcting printing unevenness of each of the M×N-number of printing elements; and a writing step of writing the correction data in the memory of the printhead.

According to still another aspect of the invention, the foregoing object is attained by providing a method of correcting a printing characteristic of a printhead having memory means capable of storing data, the printhead being manufactured by arraying and connecting N-number of circuit boards, each of which has M-number of printing elements in a predetermined direction, in the predetermined direction, machining a top board covering the connected M×N-number of printing elements, and bonding the machined top board and the connected M×N-number of printing elements, the method comprising: a monitoring step of monitoring at least one of an offset in the circuit boards, a variation in the machining of the top board, an offset in the bonding of the printing elements and the top board, a deviation in the electrical characteristics of the M×N-number of printing elements, and unevenness in printing performed by the M×N-number of printing elements; a correction-data generating step of quantifying at least one of the factors monitored in the monitor step, summing the at least one quantified factor upon weighting it while taking into account the magnitude of its influence upon printing quality of the printhead, and, on the basis of the sum obtained, generating correction data for correcting printing unevenness of each of the M×N-number of printing elements; and a writing step of writing the correction data in the memory means of the printhead.

According to still another aspect of the invention, the foregoing object is attained by providing an apparatus for correcting a printing characteristic of a printhead having a memory for storing data, the printhead being manufactured by arraying and connecting N-number of circuit boards, each of which has M-number of printing elements in a predetermined direction, in the predetermined direction, machining a top board covering the connected M×N-number of printing elements, and bonding the machined top board and the connected M×N-number of printing elements, the apparatus comprising: monitor means for monitoring at least one of an offset in the circuit boards, a variation in the machining of the top board, an offset in the bonding of the printing elements and the top board, a deviation in the electrical characteristics of the M×N-number of printing elements, and unevenness in printing performed by the M×N-number of printing elements; correction-data generating means for quantifying at least one of the factors monitored by the monitor means, summing the at least one quantified factor upon weighting it while taking into account the magnitude of its influence upon printing quality of the printhead, and, on the basis of the sum obtained, generating correction data for correcting printing unevenness of each of the M×N-number of printing elements; and writing means for writing the correction data in the memory of the printhead.

In accordance with the invention as described above, a correction is applied to a printhead having memory means for storing data is manufactured by arraying means for arraying and connecting N-number of circuit boards, each of which has M-number of printing elements in a predetermined direction, in the predetermined direction, machining means for machining a top board covering the M×N-number of printing elements connected by the arraying means, and bonding means for bonding the machined top board and the connected M×N-number of printing elements. When this correction is made, the electrical characteristics of the bonded M×N-number of printing elements of a unit of the printhead are measured, the unit of the printhead is driven to experimentally print a test pattern on a recording medium, the printed test pattern is read and a variation in printing performed by each of the M×N-number of printing elements is inspected.

At this time, an offset in the connections of the circuit boards, a variation in the machining of the top board, an offset in the bonding of the machined top board and connected circuit boards, a deviation in the measured electrical characteristics of the M×N-number of printing elements, and the inspected unevenness in printing performed by the M×N-number of printing elements are monitored. These factors monitored by the monitor means are quantified, and the quantified factors are summed upon weighting them while taking into account the magnitude of their influence upon the printing quality of the printhead. On the basis of the sum obtained, correction data for correcting the printing unevenness of each of the M×N-number of printing elements is generated and the correction data is written in the memory means of the printhead.

Alternatively, a correction is applied to a printhead having memory means for storing data is manufactured by arraying and connecting N-number of circuit boards, each of which has M-number of printing elements in a predetermined direction, in the predetermined direction, machining a covering the connected M×N-number of printing elements, and bonding the machined top board and the connected M×N-number of printing elements. When this correction is made, at least one of an offset in the connections of the circuit boards, a variation in the machining of the top board, an offset in the bonding of the machined top board and connected circuit boards, a deviation in the measured electrical characteristics of the M×N–number of printing elements, and the inspected unevenness in printing performed by the M×N–number of printing elements is monitored. At least one of the factors monitored by the monitor is quantified, and the quantified factor is summed upon weighting it while taking into account the magnitude of its influence upon the printing quality of the printhead. On the basis of the sum obtained, correction data for correcting the printing unevenness of each of the M×N–number of printing elements is generated and the correction data is written in the memory means of the printhead.

Another object of the present invention is to provide the above-mentioned corrected printhead and a printer using the printhead.

According to one aspect of the invention, the foregoing object is attained by providing a printhead corrected by the above-described printhead correcting apparatus.

According to another aspect of the invention, the foregoing object is attained by providing a printer using the above-described printhead, comprising: receiving means for receiving the correction data from the printhead; control means which, on the basis of the correction data, generates a control signal for controlling operation of said drive means in such a manner that the plurality of printing elements form uniform pixels; and transmitting means for transmitting the control signal to the printhead.

In accordance with the invention as described above, the printer using the printhead corrected as set forth above is such that the correction data that has been stored in the memory means of the printhead is received, a control signal is generated on the basis of the correction data to control the operation of the drive means, with which the printhead is provided, in such a manner that M×N–number of printing elements of the printhead form uniform pixels, and the control signal is sent to the printhead.

The invention is particularly advantageous since the process for correcting the printhead is kept simple and the means for correcting the variation in density per M×N–number of printing elements at the correction phase of head manufacture is incorporated within the printhead. This makes it possible to reduce a variation in quality of manufacture from one printhead to another and to manufacture and correct a printhead which performs high-quality printing.

This contributes to an improvement in yield in the printhead manufacturing process. As a result, a printhead capable of high-quality printing can be placed on the market at low cost.

Furthermore, in accordance with the present invention, the printer using the printhead corrected as set forth above is such that drive of the printhead is carried out, based upon the correction data that has been stored in the memory means of the printhead, in such a manner that M×N–number of printing elements of the printhead form uniform pixels. As a result, it is possible to perform high-quality printing that is independent of a variation in the quality of printhead manufacture.

Other features and advantages of the present invention will be apparent from the following description taken in conjunction with the accompanying drawings, in which like reference characters designate the same or similar parts throughout the figures thereof.

BRIEF DESCRIPTION OF THE DRAWINGS

The accompanying drawings, which are incorporated in and constitute a part of the specification, illustrate embodiments of the invention and, together with the description, serve to explain the principles of the invention.

DESCRIPTION OF THE PREFERRED EMBODIMENTS

Preferred embodiments of the present invention will now be described in detail in accordance with the accompanying drawings.

Overview of the Apparatus

Figure 1:
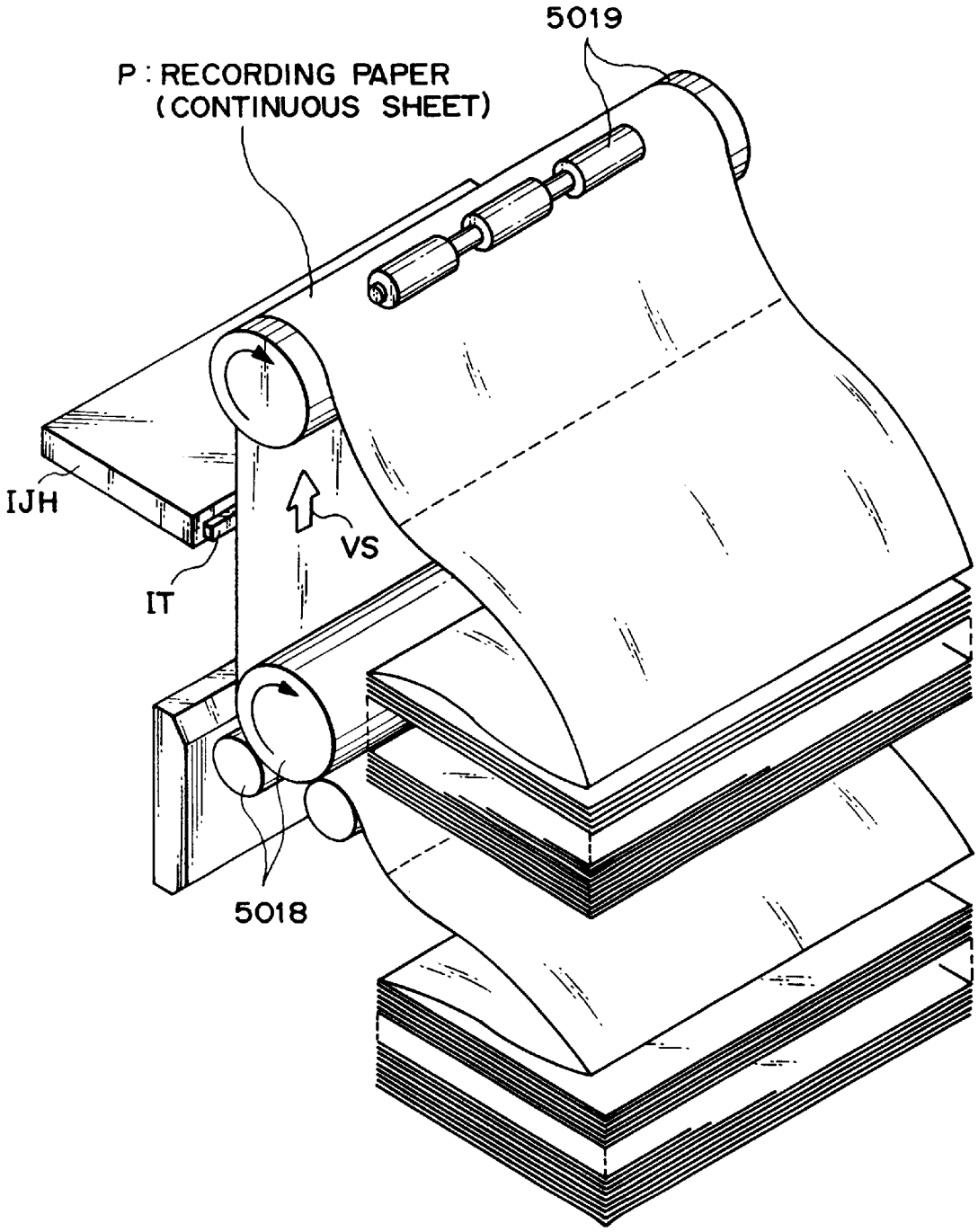
FIG. 1 is a general view of a full-line ink-jet printer, which is a typical embodiment of the present invention.

FIG. 1 is an external perspective view showing the principal portions of an ink-jet printer IJRA, which is a typical embodiment of the present invention. As shown in FIG. 1, the printer has a printhead (a full-length multiple printhead) IJH arranged along a range of full width of recording paper (a continuous sheet) P. The printhead IJH discharges ink over a range extending across the full width of the recording paper P. The ink is discharged toward the recording paper P from an orifice IT of the printhead at a prescribed timing.

In this embodiment, the continuous sheet of foldable recording paper P is conveyed in the direction VS in FIG. 1 by driving a conveying motor under the control of a control circuit, described below. An image is printed on the recording paper. The printer in FIG. 1 further includes sheet feeding rollers 5018 and discharge rollers 5019. The discharge rollers 5019 cooperate with the sheet feeding rollers 5018 to hold the continuous sheet of recording paper P at the printing position and operate in association with the sheet feeding rollers 5018, which are driven by a drive motor (not shown), to feed the recording paper P in the direction of arrow VS.

Figure 2:
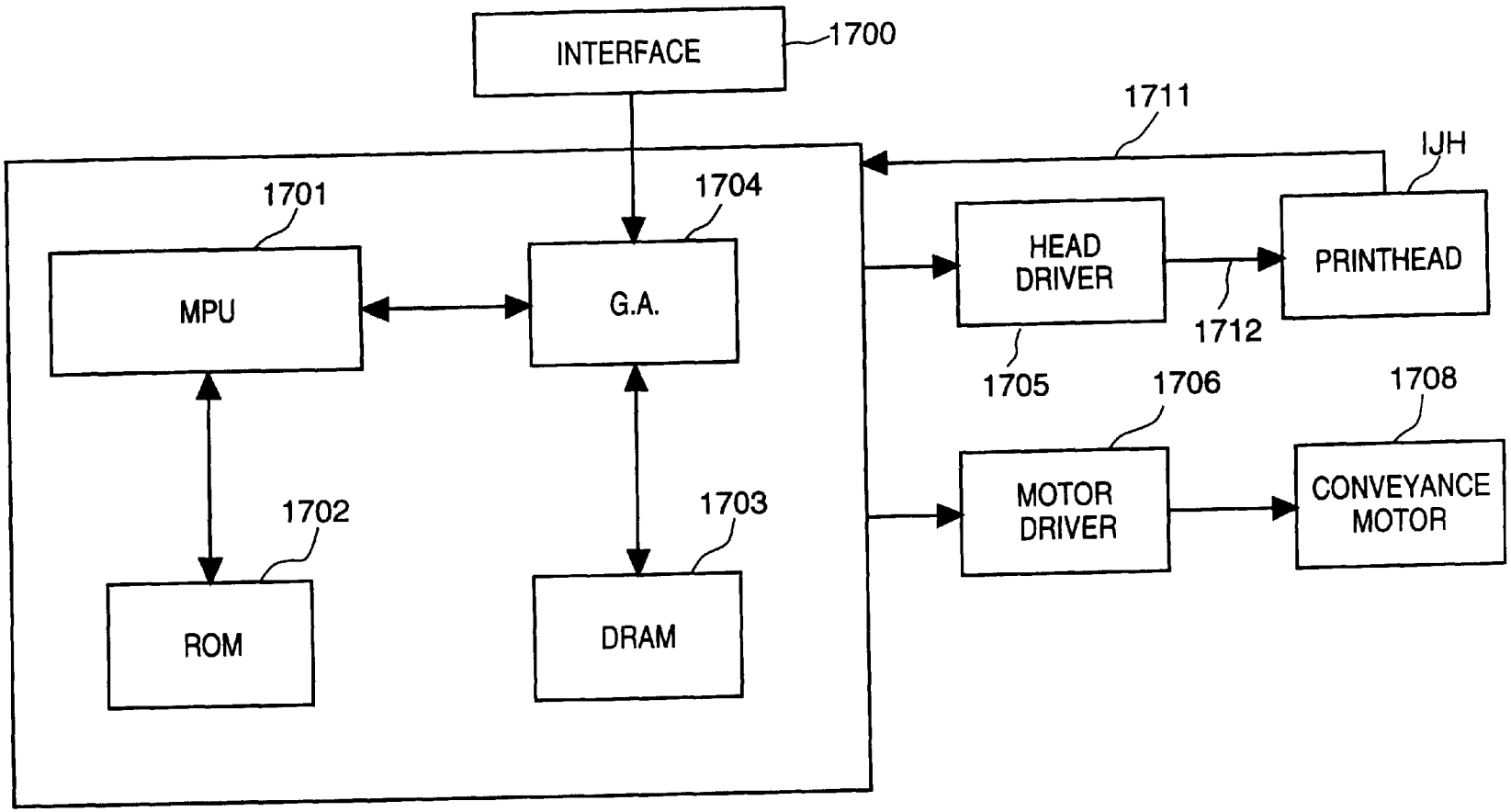
FIG. 2 is a block diagram showing a control configuration for executing control of printing in the ink-jet printer.

FIG. 2 is a block diagram illustrating the construction of the control circuit of the ink-jet printer. Shown in FIG. 2 are an interface 1700 for entering a printing signal from an external device such as a host computer, an MPU 1701, a ROM 1702 for storing a control program (inclusive of character fonts as necessary) executed by the MPU 1701, a DRAM 1703 for temporarily saving various data (the above-mentioned printing signal and printing data that is supplied to the printhead), and a gate array (G.A.) 1704 for controlling supply of printing data to the printhead IJH. The gate array 1704 also controls transfer of data among the interface 1700, MPU 1701 and RAM 1703. Also shown are a conveyance motor 1708 for conveying recording paper (the continuous sheet in this embodiment), a head driver 1705 for driving the printhead, and a motor driver 1706 for driving the conveyance motor 1708.

As for the general operation of the above-mentioned control circuit, the printing signal enters the interface 1700, whereupon the printing signal is converted to printing data for printing between the gate array 1704 and MPU 1701. The motor driver 1706 is driven into operation and the printhead IJH is driven in accordance with the printing data sent to the head driver 1705. As a result, a printing operation is carried out.

Numeral 1711 denotes a signal line for monitoring sensors (e.g., a heating-resistor sensor 314 and a temperature sensor 315, which are shown in FIG. 11) of each board, and for transmitting correction data from a memory 13 (described later) storing correction data which corrects for a variation in each board (heater board 1000, described later) provided within the printhead IJH. Numeral 1712 denotes a signal line for carrying preheating pulses, latch signals and heating pulses. On the basis of the correction data from the memory 13 such as an EEPROM of a printhead shown in FIG. 10 in the printhead IJH, the MPU 1701 sends the printhead IJH a control signal via the signal line 1712 in such a manner that the boards are capable of forming uniform pixels.

Figure 3:
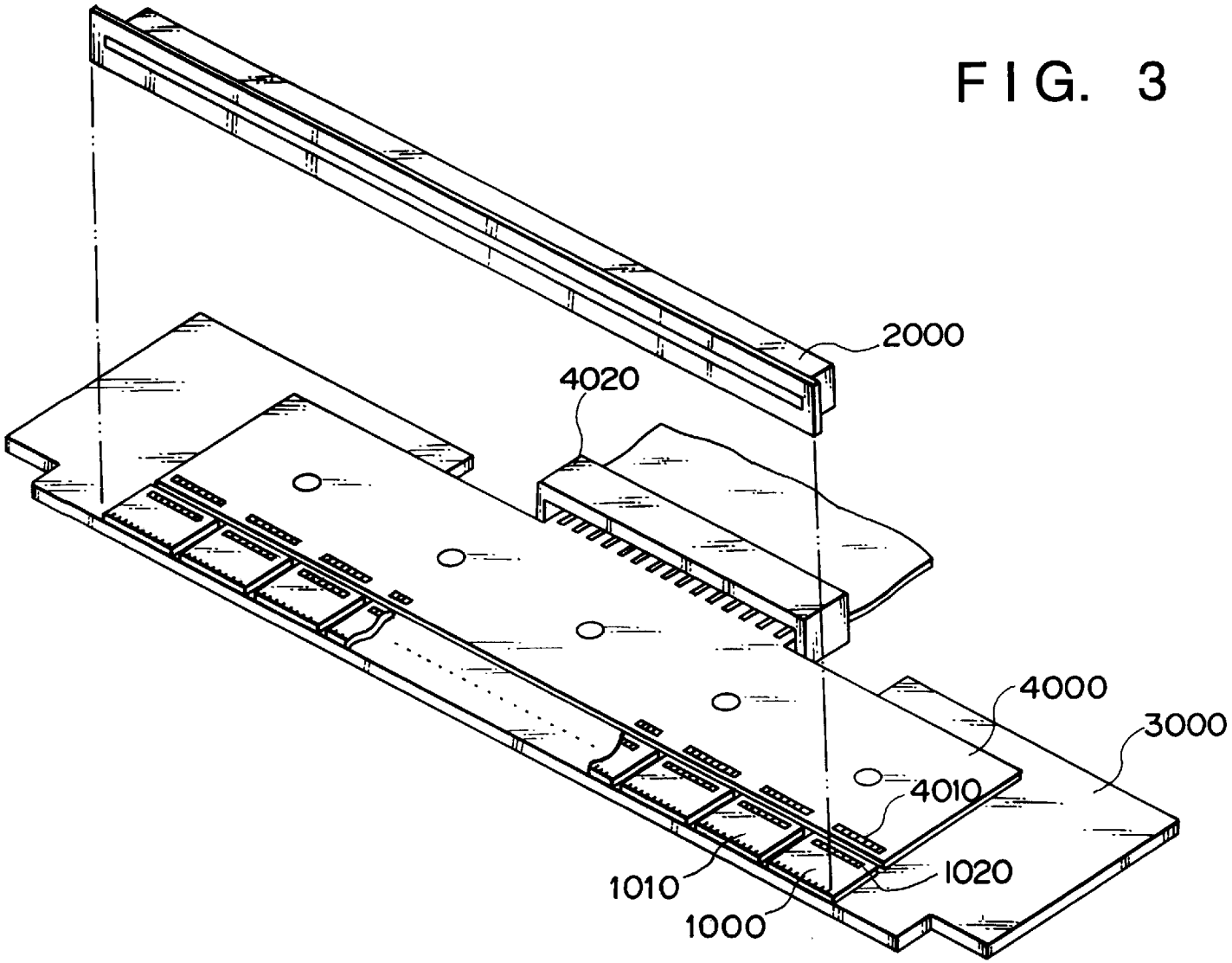
FIG. 3 is an exploded perspective view for describing the construction of a printhead according to the present invention.

FIG. 3 is an exploded perspective view for describing the construction of the printhead of this embodiment. In this example, a case is described in which the printing elements are elements for generating ink-discharge energy used to jet ink. (In a bubble-jet printing method, each element comprises a pair of electrodes and a heating resistor element provided between these electrodes).

In accordance with the method described below, the full-line printhead, which is faultlessly fabricated over its entire width by a conventional photolithographic process or the like, is obtained at a very high yield. Moreover, a single, unitary grooved member having a plurality of ink discharge orifices formed in one end and a plurality of grooves connected to these orifices and formed in the grooved member from one end to the other is joined to this printhead in such a manner that the grooves are closed by the boards, whereby a full-line, ink-jet printhead unit can be corrected in a very simple manner.

The ink-jet printhead described in this embodiment has ink discharge orifices at a density of 360 dpi (70.5 $\mu$m), the number of nozzles thereof being 3008 (for a printing width of 212 mm).

In FIG. 3, the board (hereinafter referred to as a heater board) 1000 has 128 discharge-energy generating devices 1010 arranged at prescribed positions at a density of 360 dpi. Each heater board 1000 is provided with a signal pad to drive the discharge-energy generating devices 1010 at any timing by externally applied electric signals, and with a power pad 1020 for supplying an electric power for the driving.

The row of the heater boards 1000 is fixedly bonded by a bonding agent to the surface of a base plate 3000 made of a material such as metal or ceramic.

Figure 4:
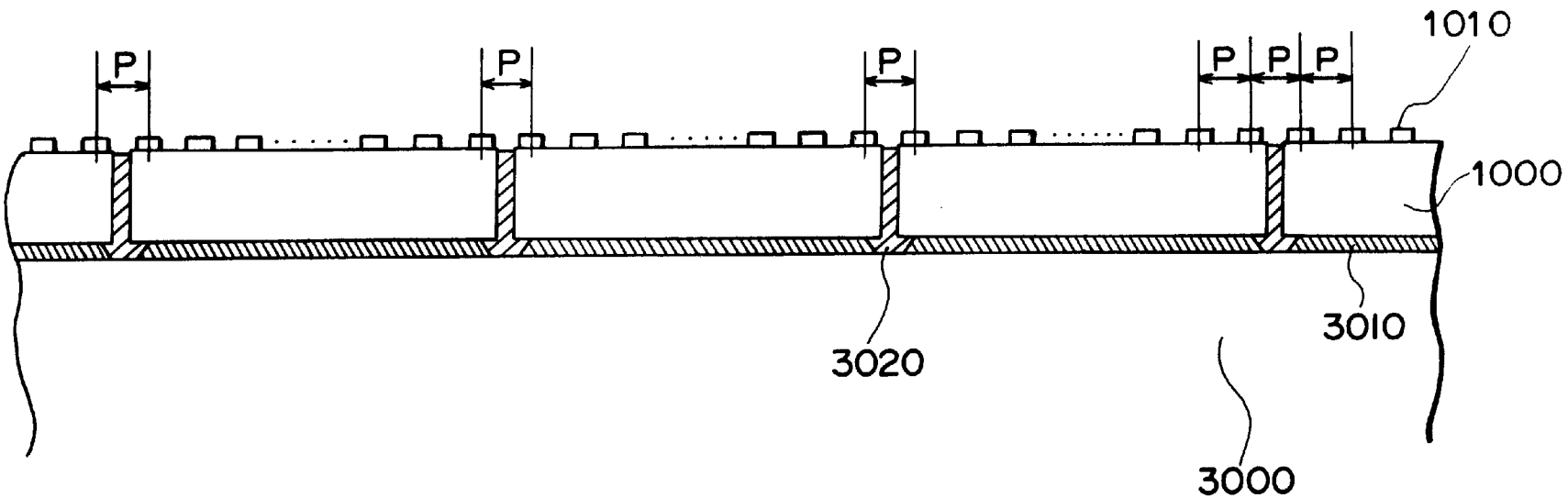
FIG. 4 is a detailed view showing heater boards arranged side by side.

FIG. 4 is a detailed view showing the heater boards 1000 in the arrayed state. The heater boards are fixedly bonded to a prescribed location on the base plate 3000 by a bonding agent 3010 applied to a prescribed thickness. At this time each heater board 1000 is fixedly bonded in precise fashion in such a manner that the spacing or pitch between the discharge-energy generating devices 1010 situated at the respective edges of two mutually adjacent heater boards will be equal to the spacing or pitch P (=70.5 $\mu$m) of the discharge-energy generating devices 1010 on each heater board 1000. Further, the gaps produced between adjacent heater boards 1000 are filled and sealed by a sealant 3020.

With reference again to FIG. 3, a wiring board 4000 is fixedly bonded to the base plate 3000 in the same manner as the heater boards. At this time the wiring board 4000 is bonded to the base plate 3000 in a state in which the pads 1020 on the heater boards 1000 are in close proximity to signal-power supply pads 4010 provided on the wiring board 4000. A connector 4020 for receiving a printing signal and driving power from the outside is provided on the wiring board 4000.

A grooved member 2000 will now be described.

Figure 5D:
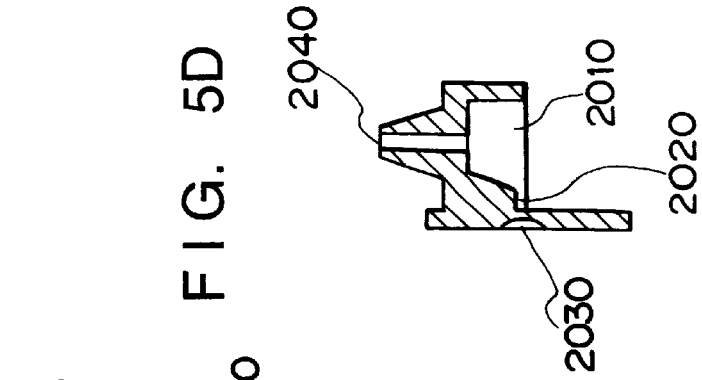
FIGS. 5A, 5B, 5C and 5D illustrate the shape of a grooved member.
Figure 5A:
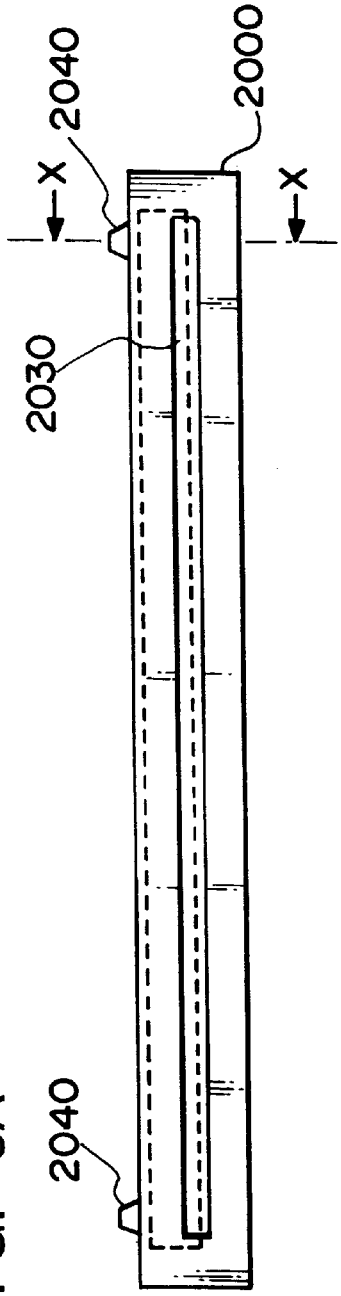
Figure 5B:
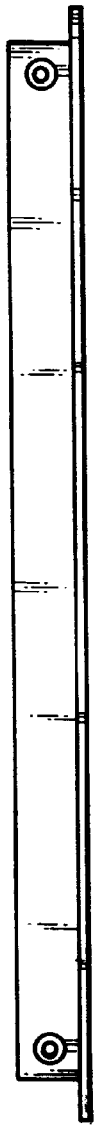
Figure 5C:
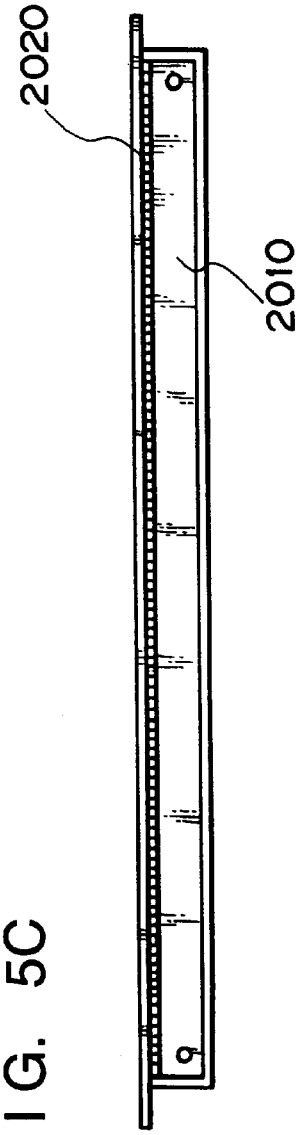

FIGS. 5A~5D are diagrams showing the shape of the grooved member 2000. FIG. 5A is a front view in which the grooved member 2000 is seen from the front, FIG. 5B a top view in which FIG. 5A is seen from the top, FIG. 5C a bottom view in which FIG. 5A is seen from the bottom, and FIG. 5D a sectional view taken along line X—X of FIG. 5A.

In FIGS. 5A~5D, the grooved member 2000 is shown to have a flow pass 2020 provided to correspond to each discharge-energy generating element 1010 provided in the heater board 1000, an orifice 2030 corresponding to each flow pass 2020 and communicating with the flow pass 2020 for discharging ink toward the recording medium, a liquid chamber 2010 communicating with each flow pass 2020 in order to supply it with ink, and an ink supply port 2040 for feeding ink, which has been supplied from an ink tank (not shown), to the liquid chamber 2010. The grooved member 2000 naturally is formed to have a length large enough to substantially cover the row of discharge-energy generating devices arranged by lining up a plurality of the heater boards 1000.

With reference again to FIG. 3, the grooved member 2000 is joined to the heater boards 1000 in a state in which the positions of the flow pass 2020 of the grooved member 2000 are made to exactly coincide with the positions of the discharge-energy generating elements (heaters) 1010 on the heater boards 1000 arranged in a row on the base plate 3000.

Conceivable methods of joining the grooved member 2000 are a method in which the top board is pushed in mechanically using springs or the like, a method in which the grooved member 2000 is fixed by a bonding agent, and a method which is a combination of these methods.

Figure 6:
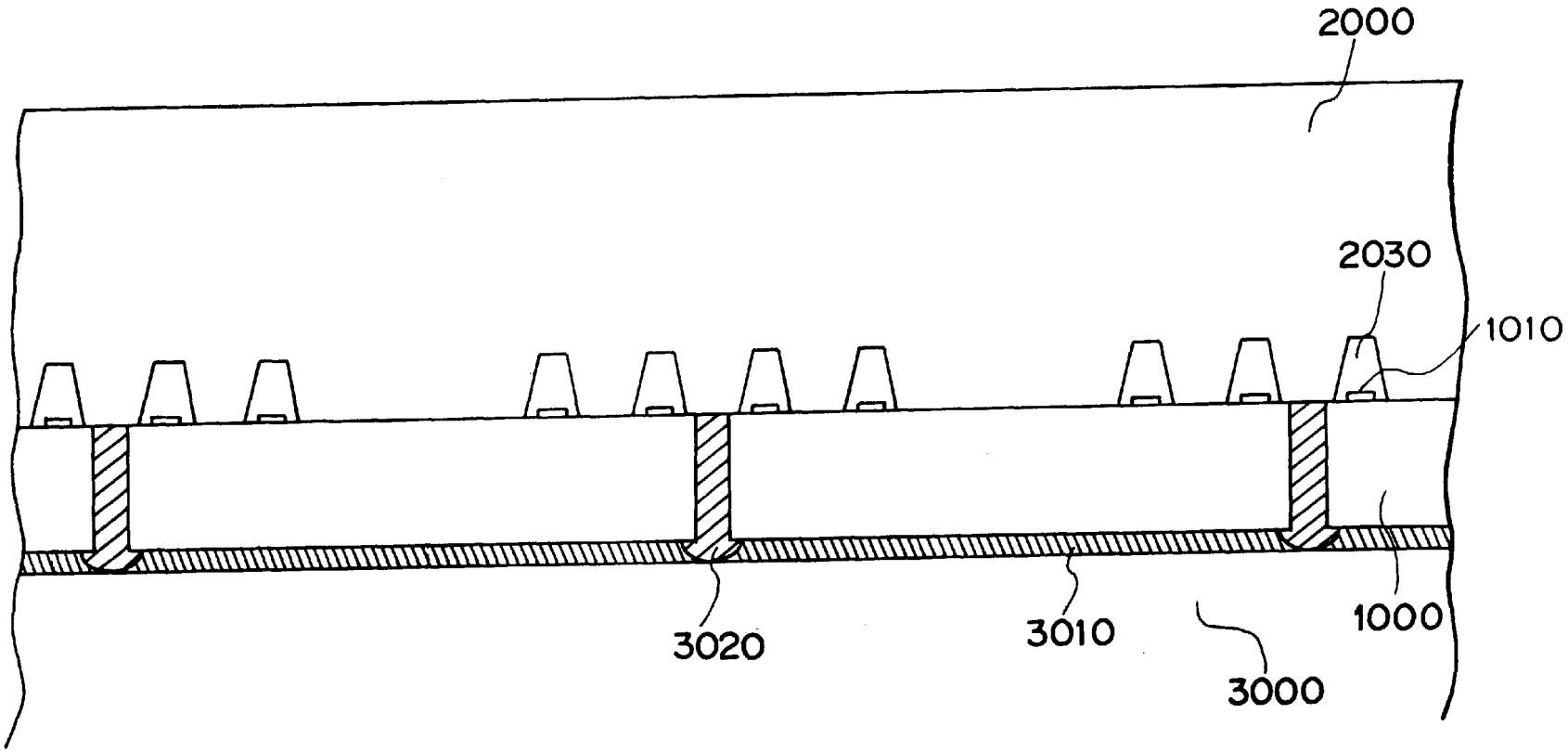
FIG. 6 is a diagram showing the grooved member and heater boards in a fixed state.

The grooved member 2000 and each of the heater boards 1000 are secured in the relationship shown in FIG. 6 by any of these methods.

The grooved member 2000 described above can be manufactured using well-known methods such as machining by cutting, a molding method, casting or a method relying upon photolithography.

Figure 7:
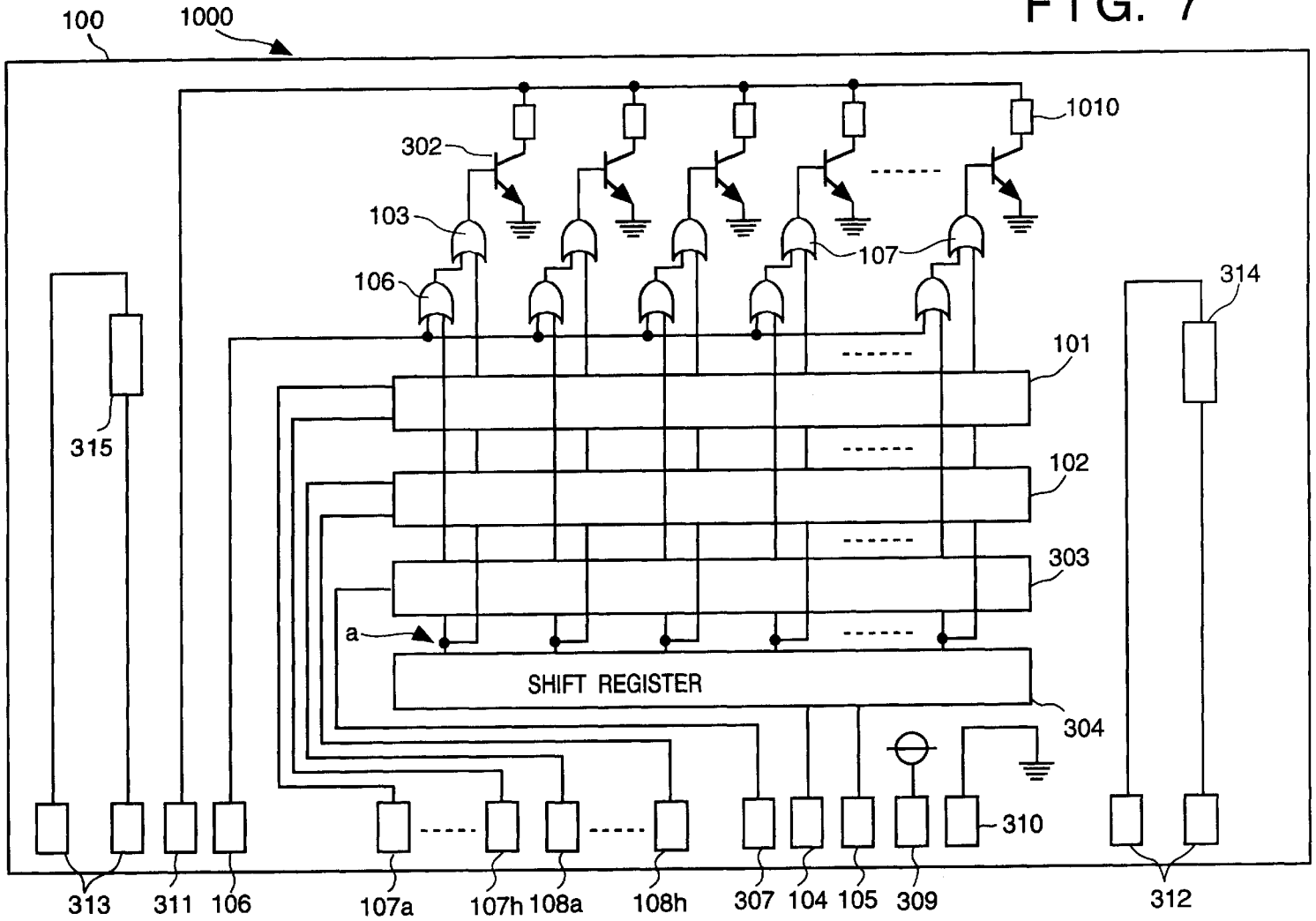
FIG. 7 is a diagram showing an example of the circuit arrangement of a drive circuit provided on the heater board for the printhead.

FIG. 7 shows an example of drive circuitry provided on the heater board 1000 of the printhead. Numeral 100 denotes a base, 101 a logic block for selecting preheating pulses, 303 a latch for temporarily storing image data, 102 a selection-data saving latch, having the same circuit arrangement as the latch 303, for selecting preheating pulses, and 103 an OR gate for taking the OR of heating pulses and preheating pulses.

The operation of this drive circuitry will now be described in line with a driving sequence.

After power is introduced from a logic power source 309, preheating pulses are selected independence upon the characteristic of the amount of ink discharged (per application of a pulse at a fixed temperature). The characteristic is measured in advance. Data of each nozzle for selecting the preheating pulses in dependence upon the aforesaid characteristic is saved in the selection-data saving latch 102 using a shift register 304 for entering image data serially. Since shared use is made of the shift register 304 for entering image data, it will suffice merely to increase the number of latch circuits and latch the outputs of the shift register 304 as input signals in parallel fashion, as shown at points a in FIG. 7. This makes it possible to prevent an increase in the surface area of the elements other than that of the latch circuits. Further, in a case where the number of preheating pulses is increased and the number of bits necessary for selection of the number of pulses surpasses the number of bits of the shift register 304, this can readily be dealt with if the latch 102 is made plural in number and a latch-clock input terminal 108 which decides latching is made plural in number, as shown at 108*a*~108*h*. It will suffice if the saving of data for selection of the preheating pulses is performed one time, such as when the printer is started up. The image-data transfer sequence will be performed exactly the same as conventionally even if this function is incorporated.

Entry of heating signals will now be described as a sequence with follows completion of the storing of saved data, representing the amount of ink discharge, for selection of preheating pulses.

A characterizing feature of this board is that a heating input terminal 106 and a plurality of preheating input terminals 107*a*~107*h*, which are used for changing the amount of ink discharged, are separately provided. First, a signal from the heating-resistor monitor 314 is fed back and a heating signal having a pulse width of an energy suited to discharge of ink in dependence upon the value of feedback is applied to the heating input terminal 106 from the side of the printing apparatus. Next, the pulse width and timing of each of the plurality of preheating signals are changed in dependence upon the value from the temperature sensor 315 and, at the same time, preheating signals are applied from the plurality of preheating pulse terminals 107*a*~107*h* in such a manner that the amount of ink discharged will vary under fixed temperature conditions. Thus, if a selection is made to deal with a factor other than temperature, namely a change in the amount of ink discharge of each nozzle, the amount of ink discharge can be rendered constant to eliminate unevenness and blurring. One of the plurality of preheating pulses thus entered is selected in dependence upon selection data saved in advance in the preheat selection logic block (latch) 102. Next, an AND signal between the image data and heating signal is OR-ed with a selected preheating pulse by the OR gate 103, and the resulting signal drives a power transistor 302, thereby passing an electric current through the heater 1010 to discharge ink.

Shown in FIG. 7 are an input signal input terminal 104, a clock input terminal 105, a latch signal input terminal 307, a ground terminal 310, a power-supply voltage input terminal 311 for heating purposes, an output terminal 312 for heating-resistor monitoring data, and an output terminal 313 for data indicating the temperature inside the printhead.

Figure 8:
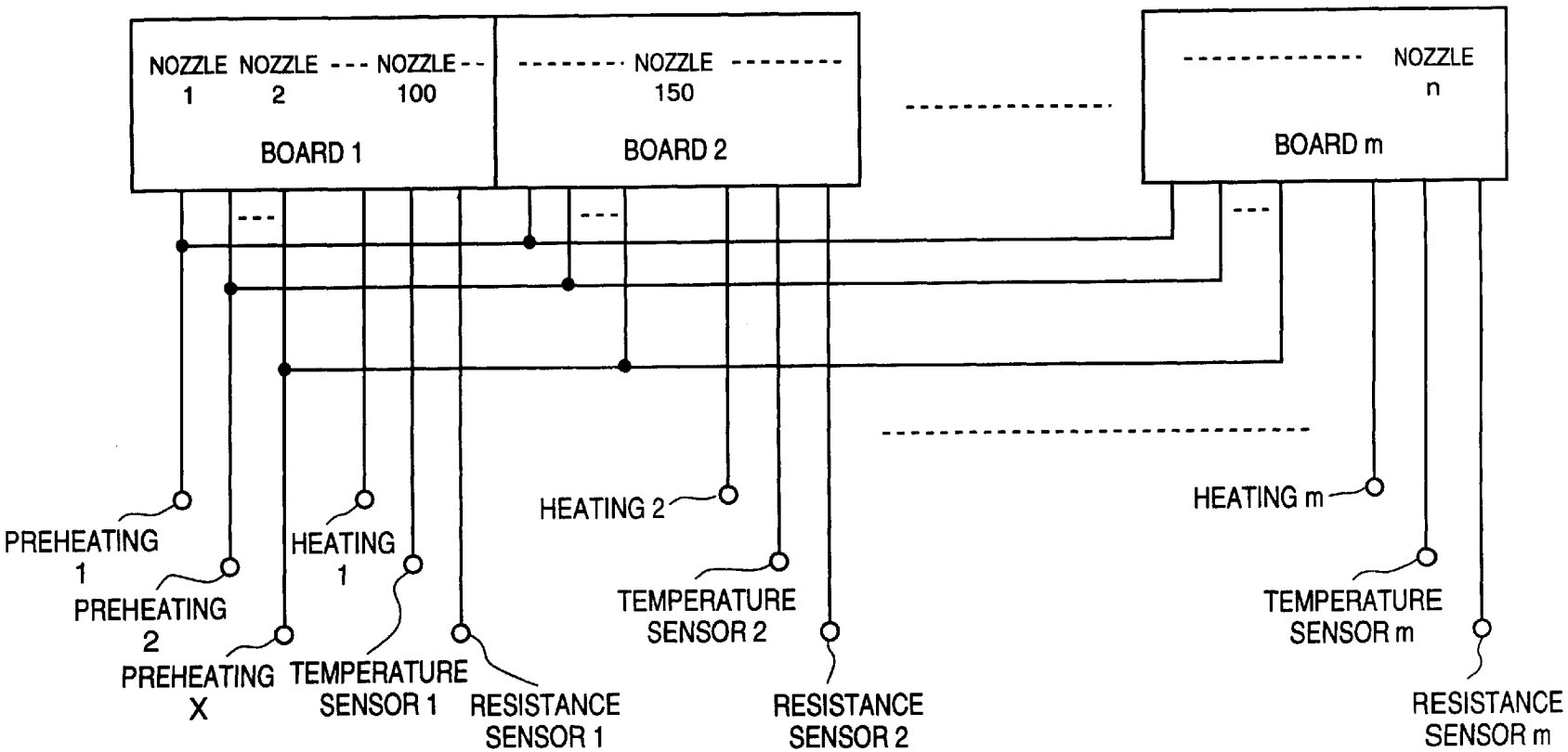
FIG. 8 is a block diagram showing a multiple-nozzle head constituted by an array of a plurality of heater boards.

Reference will be had to FIG. 8 to describe the construction of a multiple-nozzle head constituted by a plurality of the heater boards 1000 arranged in a row. There are m-number of boards in the row and a total of n-number of nozzles. The description will focus on nozzles 1, 100 of board 1 and nozzle 150 of board 2.

Figure 9:
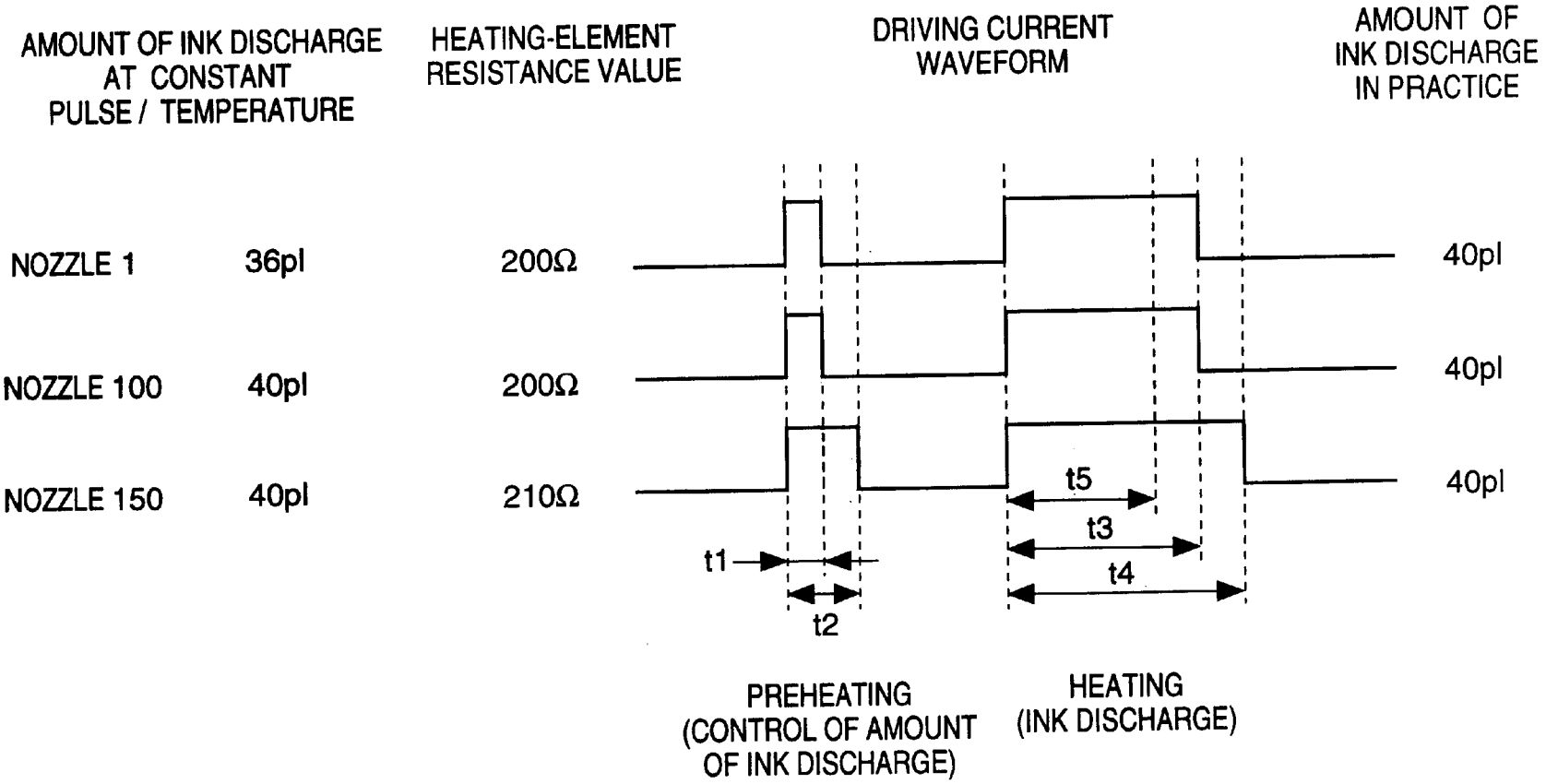
FIG. 9 is a diagram showing an example of control of driving current waveforms for driving the printing elements.

As shown in FIG. 9, assume that the amounts of ink discharged by nozzles 1, 100 and 150 are 36 pl, 40 pl and 40 pl, respectively, at application of a constant pulse width at a constant temperature. In such case, selection data having a level such that the amount of ink discharged will be greater for nozzle 1 than for nozzles 100, 150 is set in the selection-data saving latch. Since it is known from resistance sensors 1, 2 that 200 Ω is the heating-resistance value of board 1 and that 210 Ω is the heating-resistance value of board 2, as shown in FIG. 9, the pulse width applied to board 2 is made larger than that applied to board 1 so that the introduced power will be rendered uniform. FIG. 9 illustrates driving current waveforms applied under these conditions. It will be understood that the preheating pulse of nozzle 1 which discharges a small amount of ink has a pulse width larger than that of the preheating pulses for nozzles 100 and 150 ($t1<t2$). Further, the heating pulse width $t4$ is larger than $t3$ ($t4>t3$). In FIG. 9, $t5$ represents the pulse width for minimum power needed to foam the ink and cause the ink droplets to be discharged from the nozzles. The following relationships hold: $t1$, $t2<t5$ and $t3$, $t4>t5$.

Thus, the preheating pulses are changed under conditions in which the relations $t1<t2$; $t1$, $t2<t5$ hold with respect to a change in the temperature of the board during drive. As a result, the amount of ink discharged from each nozzle during actual drive can be made 40 pl at all times. This makes it possible to achieve high-quality printing without unevenness and blurring. Furthermore, with regard to the heating pulses exhibiting a high power, the pulse width is adjusted in dependence upon the resistance value of the board, whereby a constant power is applied without waste. This contributes to a longer service life for the printhead.

An apparatus and method for correcting the printhead constructed as set forth above will now be described.

Figure 10:
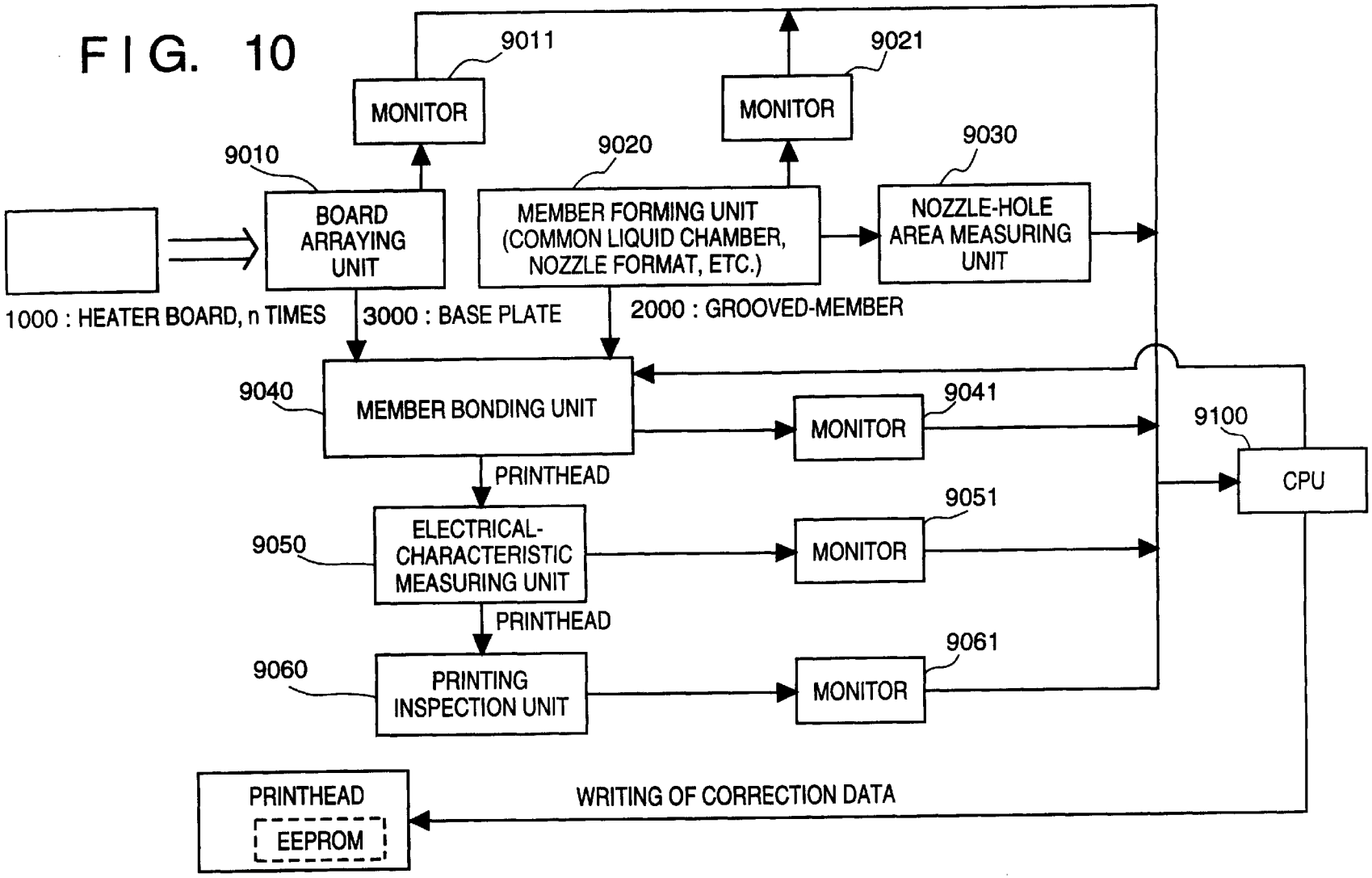
FIG. 10 is a block diagram schematically showing an apparatus for correcting a printhead.

FIG. 10 is a block diagram schematically showing an apparatus for correcting a printhead.

This apparatus manufactures and corrects a full-line printhead unit of the kind shown in FIG. 3 using n-number of printing elements (to which the heater boards 1000 in FIG. 3 correspond) of circuit boards manufactured using a well-known semiconductor manufacturing process.

First, a base plate 3000 on which n-number of heater boards 1000 in FIG. 3 are arrayed in a line is manufactured by a board arraying unit 9010. Meanwhile, a member forming unit 9020 manufactures the grooved member 2000, which is formed to include a common liquid chamber and nozzles for each of the printing elements of the ink-jet printhead. Further, the diameters of the nozzle holes formed are measured by a nozzle-hole area measuring unit 9030, whereby the areas of the nozzles are determined.

Next, the manufactured base plate 3000 and the grooved member 2000 are bonded together by a board bonding unit 9040, whereby a printhead unit is manufactured. The printhead unit thus manufactured has its electrical characteristics measured by an electrical-characteristic measuring unit 9050. The quality of the printhead unit is thus managed. Furthermore, the printhead unit whose electrical characteristics have thus been measured is made to actually perform a printing operation at a printing inspection unit 9060, whereby the printing quality of the unit is inspected.

In the printhead manufactured by the apparatus constructed as set forth above, the physical characteristics of the various components of the apparatus have a direct or indirect influence upon a deviation in the printing characteristics of the printhead. The characterizing physical quantities are measured and monitored at each of the manufacturing steps executed by the components of the apparatus, and signals representing these physical quantities are transferred to a CPU 9100. This makes it possible to correct the manufactured printhead.

Figure 11A:
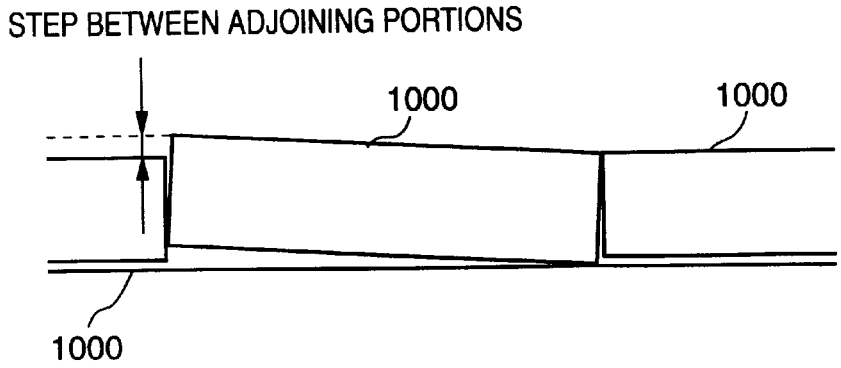
FIGS. 11A, 11B and 11C are diagrams illustrating various examples of array errors that result when boards are arrayed.
Figure 11B:
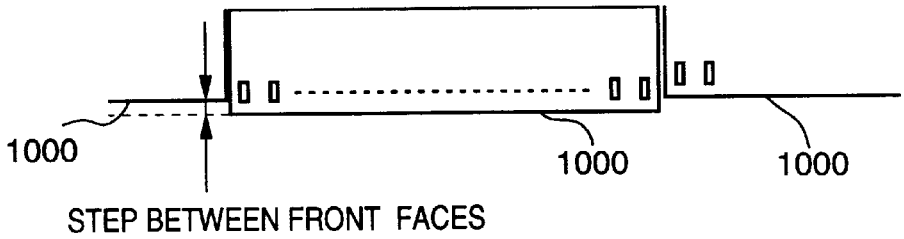
Figure 11C:
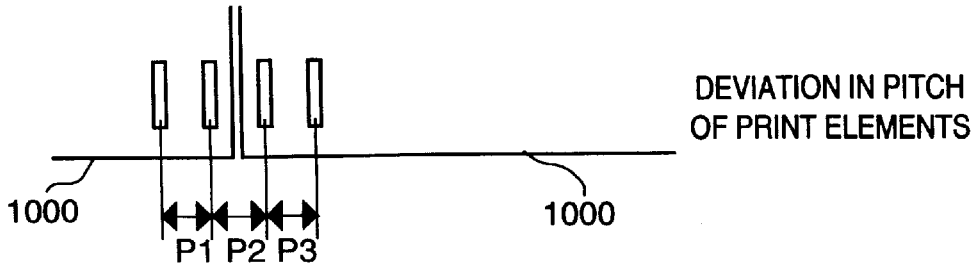

By way of example, 128 ink discharge heaters (printing elements) are arrayed per board, and n-number of the heater boards (HBO) on which a logic circuit for driving and controlling these printing elements has been packaged are arrayed at the board arraying unit 9010. The absolute precision with which the heater boards are arranged is a problem at the board arraying unit 9010. As shown in FIG. 11, the problem includes a step (FIG. 11A) at the adjoining portions of mutually adjacent heater boards, a step (FIG. 11B) at the front faces of the heater boards, and a deviation (FIG. 11C) in the pitch of the printing elements. Further, a variation in the thicknesses of the heater boards (HBO) manufactured at the semiconductor manufacturing step also results in a difference in the ink discharge characteristics brought about by a variation in the height of the nozzles at the time of nozzle connection. Such physical quantities are measured by a monitoring unit 9011, the items measured are weighted in accordance with a degree of importance, which is a factor in ink discharge performance, and the results are outputted to the CPU 9100.

Figure 12A:
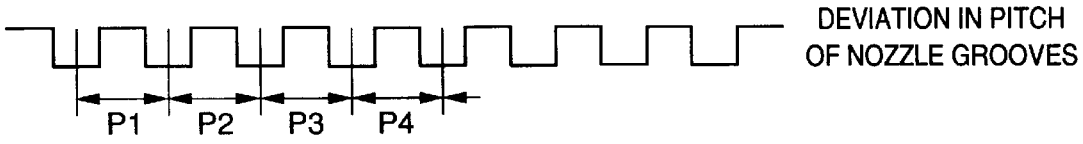
FIGS. 12A and 12B are diagrams illustrating various examples of manufacturing errors that accompany the forming of a grooved member.
Figure 12B:
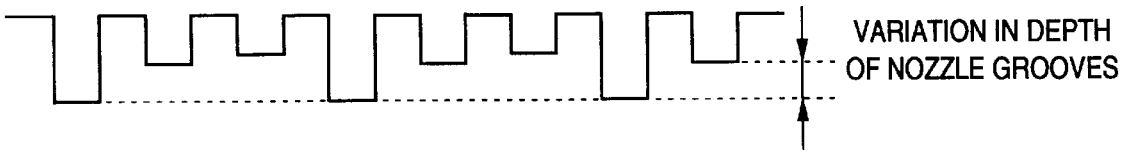
Figure 13A:
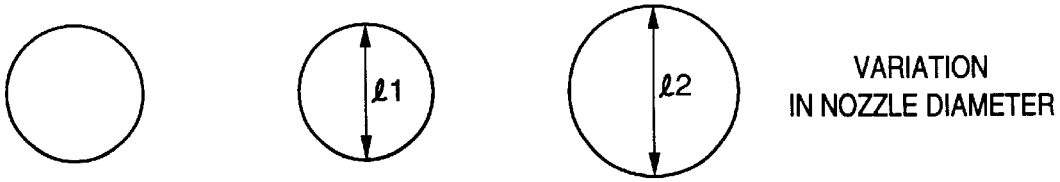
FIGS. 13A and 13B are diagrams illustrating various examples of manufacturing errors that accompany the forming of nozzle holes.
Figure 13B:
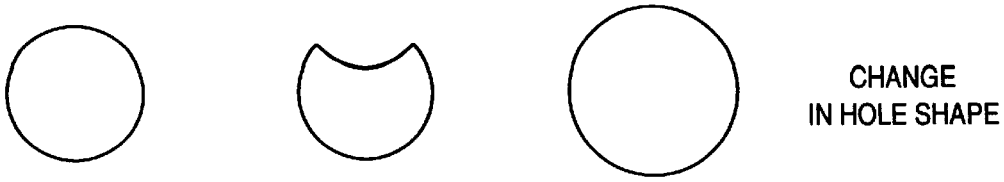

The common liquid chamber and nozzles for each printing element are formed by the member forming machining unit 9020. In the case of a full-line printhead, however, the grooves of the nozzles over one line cannot be formed at one time and, hence, sub-divided (area-divided) machining is performed. A physical fluctuation such as in the diameters of the nozzle holes produced at the time of sub-divided machining is outputted to the CPU 9100 while being monitored and totalized by a monitoring unit 9021. As shown in FIG. 12, the monitored and totalized physical quantities include a deviation (FIG. 12A) in the pitch of the nozzle grooves and a variation (FIG. 12B) in the depth of the grooves. As shown in FIG. 13A, nozzle cross-section area and hole shape (FIG. 13B), which have a major influence upon the amount of ink discharged, are measured by the nozzle-hole area measuring unit 9030 based upon the diameter of the nozzle hole at the same time that the nozzle holes are machined, and this data is outputted to the CPU 9100.

Figure 14A:
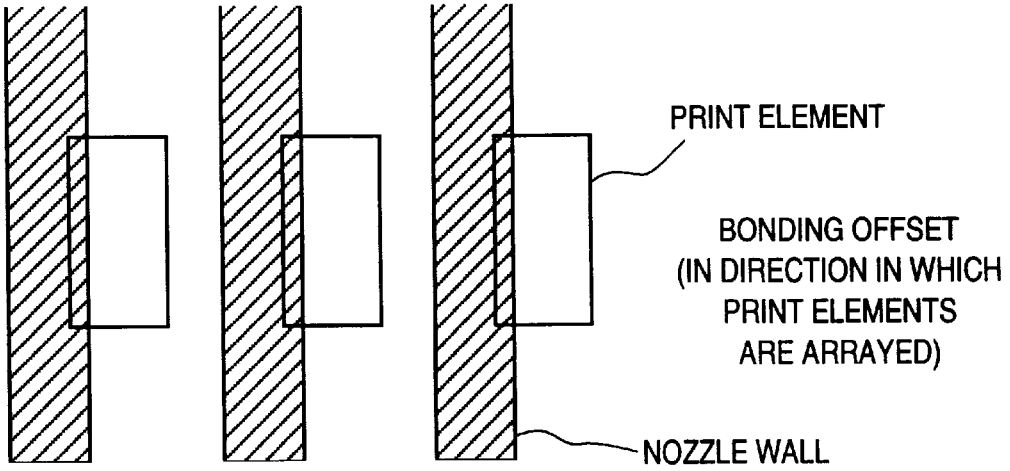
FIGS. 14A and 14B are diagrams illustrating various examples of manufacturing errors that accompany the bonding of grooved members.
Figure 14B:
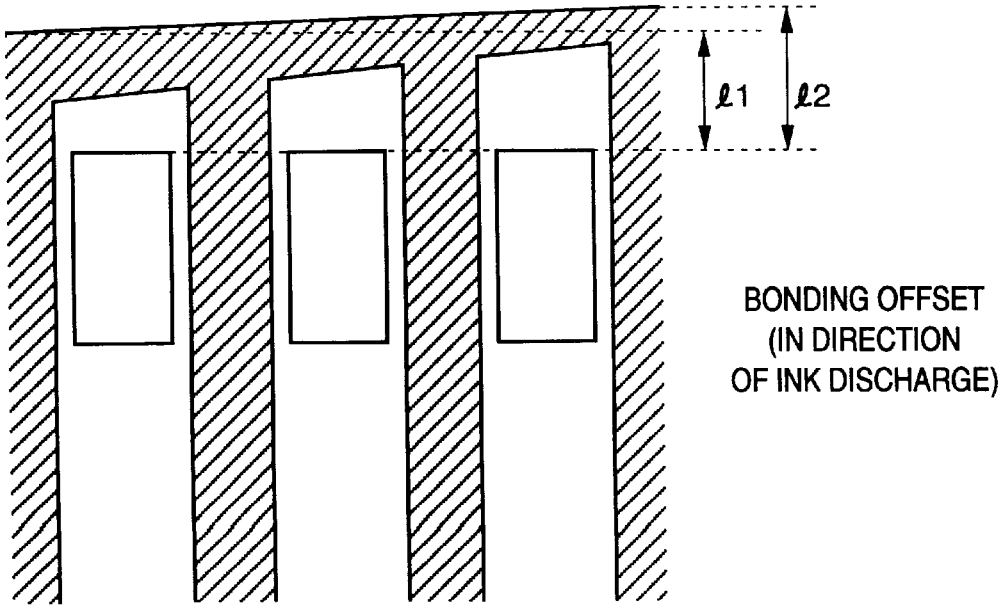

The member bonding unit 9040 bonds the heater boards (HBO) and top board together while referring to data resulting from monitoring by the board arraying unit 9010 and member forming unit 9020 and fed back from the CPU 9100. Thus, various items of information relating to quality from earlier process steps are reflected in latter process steps. Here also an offset in the positions of the nozzles relative to the heater board (HBO) has a major influence upon the amount of ink discharged and therefore the offset is totalized by the monitor 9014 and transferred to the CPU 9100. The reason for this is as follows: When the printing elements and nozzles shift in the direction in which the heater boards are arrayed, as shown in FIG. 14A, the amount of ink foaming diminishes and the amount of ink discharged is reduced. On the other hand, when the shift occurs in the direction in which the ink is discharged, as shown in FIG. 14B, the distance between the ink orifices and the heater board changes and, hence, so does the amount of ink discharged.

Figure 15:
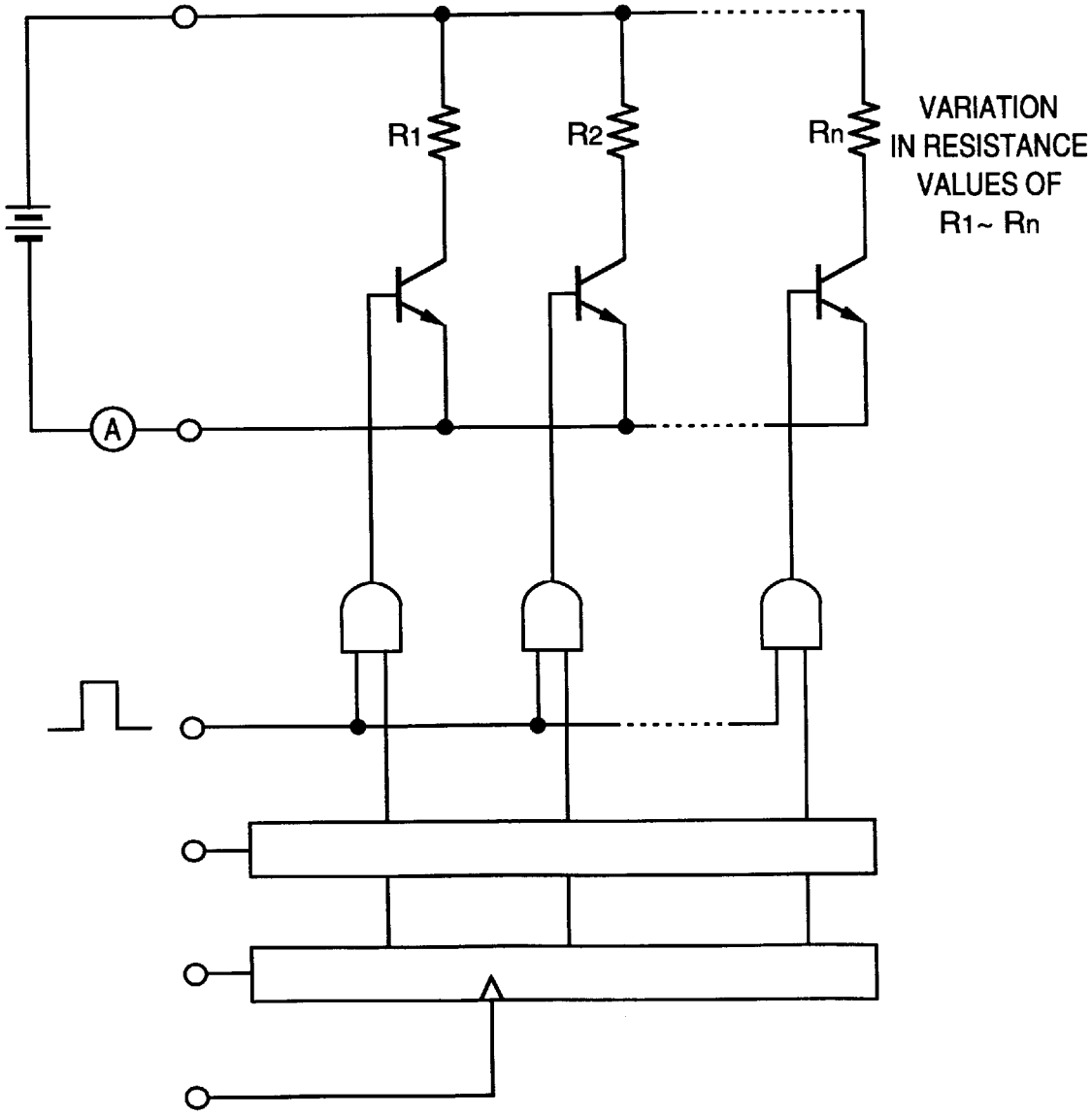
FIG. 15 is a diagram showing the manner in which the electrical characteristics of a printhead are measured.

The electrical-characteristic measuring unit 9050 verifies the electrical connections of each of the heaters on the heater board (HBO) by means of a circuit of the kind shown in FIG. 15 using wire bonding, thereby acquiring the resistance value of each heater. A variation in each resistance value can be determined from the resistance values by the monitoring unit 9051. Electric current with respect to an identical applied voltage can be determined from the resistance value of each electrothermal transducer, and data necessary for control to generate the same thermal energy from each printing element is supplied.

Finally, the manufactured printhead is made to actually perform printing operation on a recording medium such as recording paper at the printing inspection unit 9060, the printing is read by a CCD scanner (not shown) or the like, density indicative of the actually printed density obtained from the reading operation is monitored by a monitoring unit 9061 and the monitored data is outputted to the CPU 9100.

All of the information thus obtained is digitized and the digitized data is edited and processed by the CPU 9100.

On the basis of the information obtained, correction data for correcting unevenness in the printing density of each printing element is generated by the CPU 9100. With regard to the generation of the correction data, the data obtained is weighted in accordance with the magnitude of its influence upon the amount of ink discharged, the weighted values are totaled for each printing element and the total value is adopted as the correction data.

Meanwhile, the control circuit of the printer adjusts the preheating pulse width or main heating pulse width, as shown in FIG. 9, and performs control in such a manner that the amounts of ink discharged from the nozzles of the printhead are equalized. Note that the values of the above-mentioned correction data may be divided into stages in dependence upon the number of stages in which the above-mentioned adjustment can be carried out. For example, if control is capable in four stages, then the correction data obtained can be classified into four stages and new representative values corresponding to these classes of correction data can be applied.

The correction data or the representative values thereof thus obtained are written in an EEPROM, which is incorporated within the printhead, at the final manufacturing stage of the printhead by the CPU 9100, as shown in FIG. 10, thereby saving the data inside the printhead. Then, when a printer on which the printhead has been mounted performs an actual printing operation, the correction data can be used by being read out of the EEPROM. The capacity of the EEPROM need only be on the order of four times the N-number of printing elements, even in a case where the variation in the electrical characteristics is corrected every printing element. Such a capacity allows the data necessary for 16-stage printing control to be stored.

Thus, in accordance with this embodiment, physical quantities that influence the amount of ink discharge are obtained at each step of the printhead manufacturing process, and are monitored per each printing element. Furthermore, the physical quantities are weighted depending upon the degree of influence they exert upon the amount of ink discharge, the degree of influence is quantified and correction data can be generated, for each printing element, from the resulting quantified data. Furthermore, since the correction data obtained is stored in the EEPROM incorporated in the printhead, printing control utilizing this correction data can be performed when a printer using this printhead carries out printing. This makes it possible to achieve an output of a high-quality image that is free of density unevenness.

In the foregoing description, an example has been cited in which the correction data is stored in the EEPROM in the final stage of printhead manufacture. However, the correction processing may be adapted in such a manner that the correction data in the EEPROM is rewritten at each manufacturing process.

Furthermore, in a case where representative values of the correction data are generated, it goes without saying that the number of stages of control is not limited to that of the example described above.

In the description given above, monitoring units are provided in all five of the manufacturing processes. However, depending upon disparities in manufacture and influence upon the printing characteristic, it will suffice to provide at least one monitoring unit. Further, the selection of preheating pulses on a board has been described above. However, this does not impose a limitation upon the invention. For example, a density correction may be performed by changing the width of the main heating pulses using a counter or the like.

Furthermore, it goes without saying that the present invention may be applied to effect a density correction if the board is such that control of the driving power of each printing element is possible. The same density correction can be performed even if the printhead has a construction different from that described.

In the description given above, it is described that the control unit on the side of the printer controls the printing operation of the printhead on the basis of correction data that has been stored in a memory within the printhead. However, an arrangement be adopted in which such a control unit is provided within the printhead.

It goes without saying that equivalent effects are obtained even if there is a difference in the method of setting the driving power of each of the printing elements of the printhead.

Each of the embodiments described above has exemplified a printer, which comprises means (e.g., an electrothermal transducer, laser beam generator, and the like) for generating heat energy as energy utilized upon execution of ink discharge, and causes a change in state of an ink by the heat energy, among the ink-jet printers. According to this ink-jet printer and printing method, a high-density, high-precision printing operation can be attained.

As the typical arrangement and principle of the ink-jet printing system, one practiced by use of the basic principle disclosed in, for example, U.S. Pat. Nos. 4,723,129 and 4,740,796 is preferable. The above system is applicable to either one of so-called an on-demand type and a continuous type. Particularly, in the case of the on-demand type, the system is effective because, by applying at least one driving signal, which corresponds to printing information and gives a rapid temperature rise exceeding film boiling, to each of electrothermal transducers arranged in correspondence with a sheet or liquid channels holding a liquid (ink), heat energy is generated by the electrothermal transducer to effect film boiling on the heat acting surface of the printhead, and consequently, a bubble can be formed in the liquid (ink) in one-to-one correspondence with the driving signal. By discharging the liquid (ink) through a discharge opening by growth and shrinkage of the bubble, at least one droplet is formed. If the driving signal is applied as a pulse signal, the growth and shrinkage of the bubble can be attained instantly and adequately to achieve discharge of the liquid (ink) with the particularly high response characteristics.

As the pulse driving signal, signals disclosed in U.S. Pat. Nos. 4,463,359 and 4,345,262 are suitable. Note that further excellent printing can be performed by using the conditions described in U.S. Pat. No. 4,313,124 of the invention which relates to the temperature rise rate of the heat acting surface.

As an arrangement of the printhead, in addition to the arrangement as a combination of discharge nozzles, liquid channels, and electrothermal transducers (linear liquid channels or right angle liquid channels) as disclosed in the above specifications, the arrangement using U.S. Pat. Nos. 4,558,333 and 4,459,600, which disclose the arrangement having a heat acting portion arranged in a flexed region is also included in the present invention. In addition, the present invention can be effectively applied to an arrangement based on Japanese Patent Laid-Open No. 59-123670 which discloses the arrangement using a slot common to a plurality of electrothermal transducers as a discharge portion of the electrothermal transducers, or Japanese Patent Laid-Open No. 59-138461 which discloses the arrangement having an opening for absorbing a pressure wave of heat energy in correspondence with a discharge portion.

Furthermore, as a full line type printhead having a length corresponding to the width of a maximum printing medium which can be printed by the printer, either the arrangement which satisfies the full-line length by combining a plurality of printheads as disclosed in the above specification or the arrangement as a single printhead obtained by forming printheads integrally can be used.

In addition, not only an exchangeable chip type printhead, which can be electrically connected to the apparatus main unit and can receive an ink from the apparatus main unit upon being mounted on the apparatus main unit but also a cartridge type printhead in which an ink tank is integrally arranged on the printhead itself can be applicable to the present invention.

It is preferable to add recovery means for the printhead, preliminary auxiliary means, and the like provided as an arrangement of the printer of the present invention since the printing operation can be further stabilized. Examples of such means include, for the printhead, capping means, cleaning means, pressurization or suction means, and preliminary heating means using electrothermal transducers, another heating element, or a combination thereof. It is also effective for stable printing to provide a preliminary discharge mode which performs discharge independently of printing.

Furthermore, as a printing mode of the printer, not only a printing mode using only a primary color such as black or the like, but also at least one of a multi-color mode using a plurality of different colors or a full-color mode achieved by color mixing can be implemented in the printer either by using an integrated printhead or by combining a plurality of printheads.

Moreover, in each of the above-mentioned embodiments of the present invention, it is assumed that the ink is a liquid. Alternatively, the present invention may employ an ink which is solid at room temperature or less and softens or liquefies at room temperature, or an ink which liquefies upon application of a use printing signal, since it is a general practice to perform temperature control of the ink itself within a range from 30° C. to 70° C. in the ink-jet system, so that the ink viscosity can fall within a stable discharge range.

In addition, in order to prevent a temperature rise caused by heat energy by positively utilizing it as energy for causing a change in state of the ink from a solid state to a liquid state, or to prevent evaporation of the ink, an ink which is solid in a non-use state and liquefies upon heating may be used. In any case, an ink which liquefies upon application of heat energy according to a printing signal and is discharged in a liquid state, an ink which begins to solidify when it reaches a printing medium, or the like, is applicable to the present invention. In this case, an ink may be situated opposite electrothermal transducers while being held in a liquid or solid state in recess portions of a porous sheet or through holes, as described in Japanese Patent Laid-Open No. 54-56847 or 60-71260. In the present invention, the above-mentioned film boiling system is most effective for the above-mentioned inks.

In addition, the ink-jet printer of the present invention may be used in the form of a copying machine combined with a reader, and the like, or a facsimile apparatus having a transmission/reception function in addition to an image output terminal of an information processing equipment such as a computer.

The present invention can be applied to a system constituted by a plurality of devices, or to an apparatus comprising a single device. Furthermore, it goes without saying that the invention is applicable also to a case where the object of the invention is attained by supplying a program to a system or apparatus.

As many apparently widely different embodiments of the present invention can be made without departing from the spirit and scope thereof, it is to be understood that the invention is not limited to the specific embodiments thereof except as defined in the appended claims.

What is claimed is:

1. An apparatus for correcting a printing characteristic of a printhead having memory means for storing data, said printhead being manufactured by arraying means for arraying and connecting N-number of circuit boards in a predetermined direction, each of the circuit boards having a plurality of printing elements in the predetermined direction, machining means for machining a top board covering the plurality of printing elements connected by said arraying means, and bonding means for bonding the machined top board and the connected plurality of printing elements, said apparatus comprising:

measuring means for measuring electrical characteristics of the plurality of printing elements, of a unit of the printhead, bonded by said bonding means;

inspecting means for driving the unit of the printhead to experimentally print a test pattern on a recording medium, reading the printed test pattern and inspecting density unevenness in printing performed by each of the plurality of printing elements;

monitor means for monitoring factors including an offset in the connections made by said arraying means, a variation in the machining of the top board by said machining means, an offset in the bonding performed by said bonding means, a deviation in the electrical characteristics of the plurality of printing elements measured by said measuring means, and the density unevenness in printing performed by the plurality of printing elements inspected by said inspecting means;

correction-data selecting means for selecting one value of correction data from a plurality of values of correction data based on the factors monitored by said monitor means, the selected value of correction data being used to correct unevenness in the printing density of the printhead; and writing means for writing the selected value of correction data in said memory means of the printhead.

2. The apparatus according to claim 1, wherein the offset in connections made by said arraying means includes a connection offset in two directions at right angles to the direction in which the circuit boards are arrayed, and a deviation in pitch between the plurality of printing elements.

3. The apparatus according to claim 1, wherein said printhead performs printing by discharging ink from the plurality of printing elements, and said machining means forms a plurality of nozzles for discharging ink in correspondence with respective ones of the plurality of printing elements in the top board.

4. The apparatus according to claim 3, wherein the two directions at right angles to the direction in which the circuit boards are arrayed include a direction in which the ink is discharged and a direction at right angles to both the direction in which the circuit boards are arrayed and the direction in which the ink is discharged.

5. The apparatus according to claim 3, wherein the variation in the machining of the top board by said machining means includes a deviation in pitch between the plurality of nozzles, a variation in nozzle diameter of the plurality of nozzles and a variation in shape of the plurality of nozzles.

6. The apparatus according to claim 5, wherein the variation in the machining of the top board by said machining means further includes a variation in depth of grooves of the plurality of nozzles.

7. The apparatus according to claim 5, wherein the offset in the bonding performed by said bonding means includes bonding offset between printing elements and nozzles in the direction in which the plurality of printing elements are arrayed and bonding offset between printing elements and nozzles in a direction in which ink is discharged.

8. The apparatus according to claim 1, wherein each of the plurality of printing elements has an electrothermal transducer, and the deviation in the electrical characteristics of the plurality of printing elements measured by said measuring means includes a resistance value of the electrothermal transducer.

9. The apparatus according to claim 1, further comprising correction-data modifying means for modifying the selected value of correction data based on printing control characteristics of a printer using the corrected printhead.

10. An apparatus for correcting a printing characteristic of a printhead having a memory for storing data, the printhead being manufactured by arraying and connecting N-number of circuit boards in a predetermined direction, each of the circuit boards having a plurality of printing elements in the predetermined direction, machining a top board covering the connected plurality of printing elements, and bonding the machined top board and the connected plurality of printing elements, said apparatus comprising:

monitor means for monitoring two or more factors including an offset in the circuit boards, a variation in the machining of the top board, an offset in the bonding of the printing elements and the top board, a deviation in the electrical characteristics of the plurality of printing elements, and density unevenness in printing performed by the plurality of printing elements;

correction-data selecting means for selecting one value of correction data from a plurality of values of correction data based on at least two of the factors monitored by said monitor means, the selected value of correction data being used to correct unevenness in the printing density of the printhead; and writing means for writing the selected value of correction data in the memory of the printhead.

11. A method of correcting a printing characteristic of a manufactured printhead having N-number of circuit boards arrayed in a predetermined direction, each of the circuit boards having a plurality of printing elements in the predetermined direction, and a memory for storing information, said method comprising:

an arraying step of arraying and connecting the N-number of circuit boards;

a machining step of machining a top board covering a plurality of printing elements connected in said arraying step;

a bonding step of bonding the machined top board and the connected plurality of printing elements;

a measuring step of measuring electrical characteristics of the plurality of printing elements, of a unit of the printhead, bonded in said bonding step;

an inspecting step of driving the unit of the printhead to experimentally print a test pattern on a recording medium, reading the printed test pattern and inspecting density unevenness in printing performed by each of the plurality of printing elements;

a monitoring step of monitoring factors including an offset in the connections made in said arraying step, a variation in the machining of the top board in said machining step, an offset in the bonding performed in said bonding step, a deviation in the electrical characteristics of the plurality of printing elements measured in said measuring step, and the density unevenness in printing performed by the plurality of printing elements inspected in said inspecting step;

a correction-data selecting step of selecting one value of correction data from a plurality of values of correction data based on the factors monitored in said monitoring step, the selected value of correction data being used to correct unevenness in the printing density of the printhead; and a writing step of writing the selected value of correction data in the memory of the printhead.

12. The method according to claim 11, further comprising a correction-data modifying step for modifying the selected value of correction data based on printing control characteristics of a printer using the corrected printhead.

13. A printhead corrected by the method claimed in claim 11.

14. The printhead according to claim 13, comprising:

input means for externally entering printing data; and drive means for driving a plurality of printing elements based upon the printing data entered by said input means.

15. The printhead according to claim 13, wherein said memory includes an EEPROM.

16. The printhead according to claim 13, wherein said printhead is an ink-jet printhead which performs printing by discharging ink.

17. The printhead according to claim 13, wherein said printhead discharges ink by utilizing thermal energy, said printhead having a thermal energy transducer for generating thermal energy applied to the ink.

18. A printer using a printhead corrected by the method claimed in claim 11, comprising:

receiving means for receiving the correction data from the printhead;

control means which, on the basis of the correction data, generates a control signal for controlling operation of drive means in such a manner that the plurality of printing elements form uniform pixels; and transmitting means for transmitting the control signal to the printhead.

19. The printer according to claim 18, wherein said printhead is an ink-jet recording head which performs printing by discharging ink.

20. The printer according to claim 18, wherein said printhead discharges ink by utilizing thermal energy, said printhead having a thermal energy transducer for generating thermal energy applied to the ink.

21. A method of correcting a printing characteristic of a printhead having memory means capable of storing data, the printhead being manufactured by arraying and connecting N-number of circuit boards in a predetermined direction, each of the circuit boards having a plurality of printing elements in the predetermined direction, machining a top board covering the connected plurality of printing elements, and bonding the machined top board and the connected plurality of printing elements, the method comprising:

a monitoring step of monitoring two or more factors including an offset in the circuit boards, a variation in the machining of the top board, an offset in the bonding of the printing elements and the top board, a deviation in the electrical characteristics of the plurality of printing elements, and density unevenness in printing performed by the plurality of printing elements;

a correction-data selecting step of selecting one value of correction data from a plurality of values of correction data based on at least two of the factors monitored in said monitoring step, the selected value of correction data being used to correct unevenness in the printing density of the printhead; and a writing step of writing the selected value of correction data in the memory means of the printhead.

* * * * *

UNITED STATES PATENT AND TRADEMARK OFFICE

CERTIFICATE OF CORRECTION

PATENT NO. : 6,036,297
DATED : March 14, 2000
INVENTOR(S) : HAYASAKI

It is certified that error appears in the above-identified patent and that said Letters Patent is hereby corrected as shown below:

[56] References Cited:
FOREIGN PRIORITY DOCUMENTS, "2002009" should read —2-2009—, "4232749" should read —4-232749—, and "5-024192" should read —5-24192—.

COLUMN 4:
Line 25, "data is" should read —data, which is—.
Line 57, "data is" should read —data, which is—.
Line 60, "machining a" should read —machining a top board—.

COLUMN 7:
Line 47, "electrodes)." should read —electrodes.)—.

COLUMN 9:
Line 14, "independence" should read —in dependence—.
Line 39, "with" should read —which—.

COLUMN 10:
Line 36, "during drive." should read —during driving.—.
Line 38, "drive" should read —driving—.

COLUMN 13:
Line 38, "arrangement" should read —arrangement may—.
Line 57, "so-called an" should read —a so-called—.

UNITED STATES PATENT AND TRADEMARK OFFICE

CERTIFICATE OF CORRECTION

PATENT NO. : 6,036,297
DATED : March 14, 2000
INVENTOR(S) : HAYASAKI

It is certified that error appears in the above-identified patent and that said Letters Patent is hereby corrected as shown below:

COLUMN 14:

Line 6, "the" should be deleted.
Line 28, "full line" should read --full-line--.

Signed and Sealed this

Fifth Day of June, 2001

Nicholas P. Godici

NICHOLAS P. GODICI

*Acting Director of the United States Patent and Trademark Office*

*Attest:*

*Attesting Officer*